United States Patent [19]

Haller, Jr.

[11] 3,953,203

[45] Apr. 27, 1976

[54] JEWELRY ALLOYS

[75] Inventor: Mitchell W. Haller, Jr., York, Pa.

[73] Assignee: Dentsply Research & Development Corporation, Milford, Del.

[22] Filed: Jan. 24, 1975

[21] Appl. No.: 543,751

[52] U.S. Cl. ..... 75/171; 75/134 B; 75/134 F; 75/134 M

[51] Int. Cl.[2] ..... C22C 19/05

[58] Field of Search ..... 75/170, 171, 134 B, 75/134 F, 134 M; 148/32, 32.5

[56] References Cited

UNITED STATES PATENTS

| | | | |
|---|---|---|---|
| 2,628,900 | 2/1953 | Jackson et al. | 75/171 |
| 3,841,868 | 10/1974 | Dudek et al. | 75/171 |

*Primary Examiner*—R. Dean

[57] ABSTRACT

A base metal alloy primarily for jewelry use comprising a major portion of nickel and minor proportions selected from the group tin, chromium, silicon, aluminum, niobium and manganese.

8 Claims, No Drawings

JEWELRY ALLOYS

CROSS-REFERENCE TO RELATED APPLICATIONS

U.S. Pat. application Ser. No. 472,787, filed May 23, 1974, by Charles R. Manning and Mitchell W. Haller for Dental Alloy.

BACKGROUND

This invention relates to base metal alloys having particular utility for jewelry applications.

In particular, a major object of the present invention is to provide a base metal alloy to be used as an alternative to so-called white gold in jewelry applications.

In order to provide a suitable alloy capable for jewelry applications, certain characteristics should be present:

a. A melting temperature low enough to permit casting in gypsum investments while retaining compatibility with phosphate and other higher temperature investments.
b. Ability to obtain accurate casting detail.
c. Sufficient ductility in castings to allow "stretching" or changes in size of rings and other jewelry pieces.
d. Ability to solder.
e. Corrosion resistance.
f. Non-irritability to skin.
g. Ability to maintain a shine and to be polished.

The alloys of the present invention include the foregoing characteristics in addition to others which render them superior material for use in the manufacture of jewelry.

DESCRIPTION OF THE PREFERRED EMBODIMENTS

The present invention relates to metal alloys primarily useful for jewelry applications.

The alloys of the present invention are designed as alternatives to the use of gold, so-called white gold, or other noble metals, without loss of desirable qualities.

The alloys of the present invention comprise a major portion of nickel with lesser amounts of other elements as are useful to impart the properties required for jewelry use.

Polishability and the ability to maintain a shine are, of course, properties essential in a jewelry alloy. In this connection, it is important to provide an alloy which is carbon-free or essentially so, since the presence of more than about 0.1% carbon will seriously impair polishability and ductility. It is important that the carbon content be maintained below 0.1% and preferably below 0.03%.

Similarly, ductility is an important quality in jewelry alloys. The use of tin and/or manganese assists in lowering the melting range while still allowing the alloy to have sufficient ductility. The use of manganese is recommended in the approximate range of from 20 to 50%, and tin in the approximate range of from 2 to 8%. However, where non-noble metals are used, a skillful blending of components is required. For example, if excessive amounts of tin are used (above about 9% in the present case) the alloy will become brittle, and lose ductility. As mentioned, the presence of carbon in amounts over 0.1% will adversely affect ductility.

Corrosion resistance is an important factor also. Here, chromium appears to perform an important function. Thus, unless some other corrosion resistant element is used, chromium should be about 8% of the alloy. However, if more than about 18% of the alloy is chromium, there will be an undesirable loss of ductility and higher than desirable melting temperatures will be required.

The jewelry is made, generally, by casting, usually into gypsum or phosphate investment molds. Thus, the melting temperature of the alloy must be sufficiently low (e.g. about 1900°– 2400°F) for casting in gypsum investments. In this regard, tin assists in the lowering of the melting temperature. Specifically, if the alloy contains less than about 2 – 3% tin, the temperature will be too high (unless another temperature suppressing component is used). As stated, however, the use of tin must be regulated, since the inclusion of more than about 8% tin will result in a loss of ductility.

Silicon, it has been found, is a useful ingredient for jewelry alloys since, when used in the range of up to about 1%, it enhances the soldering qualities of the material. In addition, silicon acts as a "scavenger", i.e. it neutralizes impurities, and thus promotes castability. The element also tends to maintain a lower melting temperature.

Aluminum, which may be used up to about 3%, also acts as a scavenger, assists castability and enhances a desirable melting temperature. Aluminum appears to promote the ability of the alloy to withstand elongation without failure, as does manganese.

Nickel is the base material of the alloys of the present invention. This material melts at approximately 2650°F, is compatible with most investments materials, has good ductility and good corrosion resistance.

The first, preferred general group of jewelry alloys of the present invention preferably contain the following ingredients (ranges approximate):

| | |
|---|---|
| Tin: | 2 – 8% |
| Chromium: | 8 – 18% |
| Silicon: | 0 – 1% |
| Aluminum: | 0 – 3% |
| Niobium: | 0 – 10% |
| Nickel: | Balance |

The alloy compositions herein disclosed characteristically have a melting range of from about 1900°F to about 2400°F, an ultimate strength over 70,000 psi, a yield strength of over 52,000 psi, an elongation of over 5%, and a casting temperature within the capability of natural gas-oxygen torches.

The initial alloy preparation is typically carried under an argon cover employing an induction furnace, with the following order of addition of component elements. First, nickel in the form of chips, and chromium in the form of irregularly shaped granules are each weighed out in the appropriate amounts for the composition of alloy being prepared, and thereafter, placed in a crucible. The nickel and chromium components are then dispersed within a zirconia-lined crucible and melted to form a uniform aggregate mixture. An argon cover is maintained over the crucible throughout the melting. The crucible preferably is ceramic and the mixing implements quartz to prevent carbon pick-up. As previously indicated carbon should be kept below 0.1% and preferably below 0.03%.

It should be noted that the quality of all components is important in order to realize and maintain the ductility and elongation properties achievable with these particular alloy compositions.

While the uniform aggregate mixture of nickel and chromium is molten in a homogeneous liquid dispersion, the appropriate weights of silicon and niobium, are prepared for addition to the nickel-chromium melt. The silicon is preferably added in granular form, and the niobium, if used, is added in whatever appropriate form is available. This second group of components is introduced to the crucible within the furnace containing the nickel/chromium homogeneous liquid melt dispersion to form a homogeneous liquid melt mass.

The appropriate amount of tin, in elemental or prealloyed form is weighed out and added last to the melt. The tin is allowed to disperse as a liquid component within the liquid melt alloy mass to form the homogeneous alloy composition of the present invention. In connection with a second type of alloys of the present invention, manganese may be added to the melt in addition to tin. This melt can then be cast directly into investment molds of gypsum or phosphate, or can be cast into convenient shapes for later re-melting and casting into the desired shapes.

It is important in the preparation of the alloys that oxidation of components, particularly the tin, be minimized in order to adequately control the compositions of the melt. For this reason, initial preparation of the alloy composition is conducted under an argon cover, thereby reducing oxidation and consequent slag formation which would have undesirable effects on the alloy.

Likewise, as indicated, it is important that control of the carbon content of the alloys of the present invention be exercised since objectionable amounts of carbon into the alloy will degrade some of the desired properties. Preferably the alloy should not contain more than 0.1% by weight carbon.

Utilization of the alloy of the present invention in place of gold or gold alloys should not require any additional or different investment materials, casting equipment, or any significant change in technique other than that which is currently employed in a reasonably well equipped jewelry manufacturing facility as used and carried out by reasonably skilled and competent personnel. Likewise, no special handling is required in the use of the alloy of the present invention as such might be required in the use of an alloy which contained Beryllium.

The following examples illustrate alloy compositions of the first, preferred group and their percentages, by weight, of the total composition when made in accordance with the method set forth hereinbefore:

| | Percentages |
|---|---|
| EXAMPLE 1 | |
| Nickel | 79.0 |
| Chromium | 15.0 |
| Tin | 5.0 |
| Silicon | 1.0 |
| EXAMPLE 2 | |
| Nickel | 84.8 |
| Chromium | 10.0 |
| Tin | 5.0 |
| Aluminum | 0.2 |
| EXAMPLE 3 | |
| Nickel | 83.8 |
| Chromium | 10.0 |
| Tin | 6.0 |
| Silicon | 0.2 |
| EXAMPLE 4 | |
| Nickel | 84.8 |
| Chromium | 10.0 |
| Tin | 5.0 |
| Silicon | 0.2 |

-continued

| | Percentages |
|---|---|
| EXAMPLE 1 | |
| EXAMPLE 5 | |
| Nickel | 82.5 |
| Chromium | 9.0 |
| Tin | 5.0 |
| Niobium | 3.5 |

The alloys of Examples 1 – 5 melt in the range 2100° – 2400°F, and prove excellent for jewelry use, having good casting characteristics, substantial ductility, can be soldered and pass the standard corrosion tests of a jewelry manufacturer.

A second general group of alloys has been discovered which also possess useful qualities for jewelry applications, although the first group described above is preferable. The second group is of the following type:

| | |
|---|---|
| Manganese: | 20 – 50% |
| Chromium: | 8 – 20% |
| Silicon: | 0 – 1% |
| Aluminum: | 0 – 3% |
| Nickel: | Balance |

Tin may also be used, where desired.

Specific examples of the second type are as follows:

| | Percentages |
|---|---|
| EXAMPLE 6 | |
| Nickel | 69 |
| Chromium | 10 |
| Tin | 5 |
| Manganese | 15 |
| Silicon | 1 |
| EXAMPLE 7 | |
| Nickel | 70.9 |
| Chromium | 8.0 |
| Tin | 5.0 |
| Manganese | 16.0 |
| Aluminum | 0.1 |

These compositions have a relatively low melting range with the liquidus temperature being below 2200°F are very ductile and can be soldered. Generally, the alloys are acceptable for jewelry use, having the other characteristics, as described above, desirable for such use.

This invention has been described with reference to the preferred embodiments of the invention. However, the contemplated breadth of the compositions and their applications should be interpreted in light of the specification and claims to include further embodiments which employ equivalent materials for their stated function in the melt and finished alloy.

I claim:

1. An alloy having utility for fabrication into jewelry consisting essentially by weight:

| | Approximate Ranges |
|---|---|
| Tin | 2 – 8% |
| Chromium | 8 – 18% |
| Silicon | 0 – 1% |
| Aluminum | 0 – 3% |
| Niobium | 0 – 10% |
| Nickel | Balance. |

2. An alloy having utility for fabrication into jewelry consisting essentially by weight:

| | Percentages |
|---|---|
| Nickel | 79.0 |
| Chromium | 15.0 |
| Tin | 5.0 |
| Silicon | 1.0. |

3. An alloy having utility for fabrication into jewelry consisting essentially by weight:

| | |
|---|---|
| Nickel | 84.8 |
| Chromium | 10.0 |
| Tin | 5.0 |
| Aluminum | 0.2. |

4. An alloy having utility for fabrication into jewelry consisting essentially by weight:

| | Percentages |
|---|---|
| Nickel | 83.8 |
| Chromium | 10.0 |
| Tin | 6.0 |
| Silicon | 0.2. |

5. An alloy having utility for fabrication into jewelry consisting essentially by weight:

| | |
|---|---|
| Nickel | 84.8 |
| Chromium | 10.0 |
| Tin | 5.0 |

-continued

| | |
|---|---|
| Silicon | 0.2. |

6. An alloy having utility for fabrication into jewelry consisting essentially by weight:

| | |
|---|---|
| Nickel | 82.5 |
| Chromium | 9.0 |
| Tin | 5.0 |
| Niobium | 3.5. |

7. An alloy having utility for fabrication into jewelry consisting essentially by weight:

| | Percentages |
|---|---|
| Nickel | 69 |
| Chromium | 10 |
| Tin | 5 |
| Silicon | 1 |
| Manganese | 15. |

8. An alloy having utility for fabrication into jewelry consisting essentially by weight:

| | |
|---|---|
| Nickel | 70.9 |
| Chromium | 8.0 |
| Tin | 5.0 |
| Manganese | 16.0 |
| Aluminum | 0.1. |

* * * * *